United States Patent [19]

Beacham

[11] 4,248,292

[45] Feb. 3, 1981

[54] HEAT TRANSFER CONTROL CIRCUIT FOR A HEAT PUMP

[75] Inventor: William H. Beacham, Putnam, Canada

[73] Assignee: 379235 Ontario Ltd., Putnam, Canada

[21] Appl. No.: 38,128

[22] Filed: May 11, 1979

[51] Int. Cl.[3] ..... F24F 3/00; F25D 17/02; F25B 29/00; F25D 11/00

[52] U.S. Cl. ..... 165/50; 62/185; 62/325; 62/430

[58] Field of Search ..... 62/185, 325, 430; 165/50

[56] References Cited

U.S. PATENT DOCUMENTS

| | | | |
|---|---|---|---|
| 2,299,531 | 10/1942 | Crawford | 62/185 |
| 3,069,867 | 12/1962 | Ringquist | 62/185 X |
| 3,527,060 | 9/1970 | Kruggel | 62/325 X |
| 3,935,899 | 2/1976 | Jolly | 165/50 X |

OTHER PUBLICATIONS

*Electrical West*-2 Mill Commercial Heat by Reversing Refrigeration Cycle, vol. 66, No. 4, Apr. 1, 1931, pp. 177-179.

*Primary Examiner*—Lloyd L. King

[57] ABSTRACT

This disclosure relates to an apparatus for controlling the rate of heat transfer of one of the heat exchange coils in a heat pump installation.

5 Claims, 1 Drawing Figure

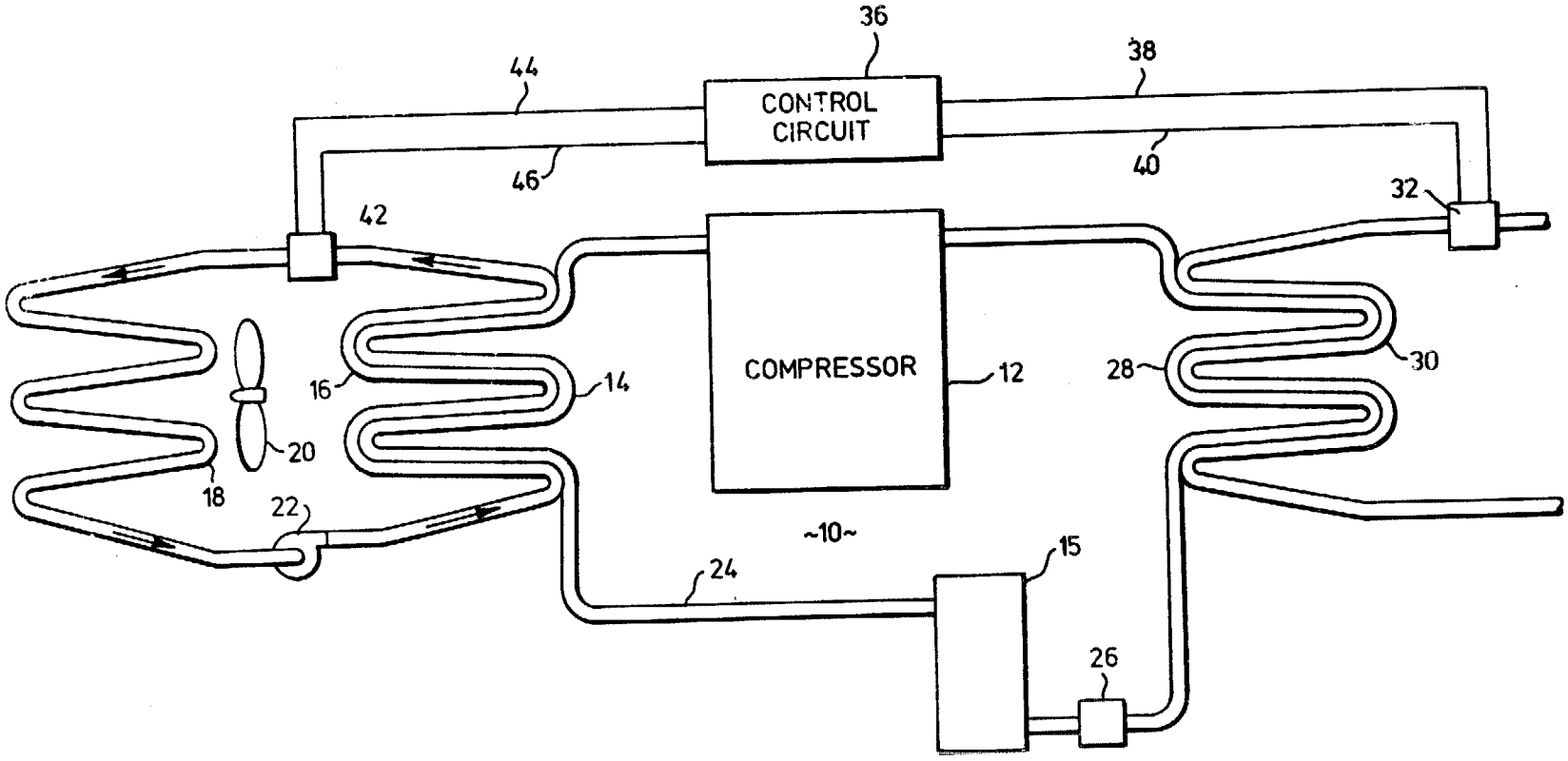
CONTROL CIRCUIT
COMPRESSOR
~10~
12
14
15
16
18
20
22
24
26
28
30
32
36
38
40
42
44
46

HEAT TRANSFER CONTROL CIRCUIT FOR A HEAT PUMP

BACKGROUND OF THE INVENTION

A heat pump is a device which is used to pump heat from a source of heat at a particular temperature or energy level to a heat sink at a higher temperature or energy level than the source.

In practical applications, the design of a heat pump installation involves the selection of a particular heat transfer area for heat transmission of the evaporator and condenser to match the power capability of the motor-compressor unit which will be required to pump heat between a particular range of temperature differential between the heat source and heat sink.

In most instances, the work done by the compressor on the refrigerant will be sufficient to cause the temperatures of the evaporator and condenser coils to be sufficiently displaced from one another such that the compressor work done on the refrigerant is just sufficient to maintain the desired design temperature of the condenser and evaporator coils.

Under certain operating conditions, because of peculiar heat transfer conditions which may lie outside the design limits of the heat transfer coils of the condenser and evaporator, operation of the heat pump may have to be discontinued or modified to permit operation of the motor compressor.

Under certain circumstances in the operation of a heat pump in a situation where the energy levels of the heat source and heat sink are very close together, the motor compressor in attempting to do its rated work on the refrigerant fluid may cause the output pressure at the head of the compressor to escalate beyond design pressures in the unusual operating circumstances.

In large heat pump installations, some relief must be provided in order to prevent damage to the components of the heat pump installation until the operation of the heat pump is restored to normal. This relief may be in the form of some kind of unloader valve which opens under conditions where high head pressures occur in compressor operation, the opening of the unloader valve permits refrigerant to flow through the compressor without any work having been done on the refrigerant passing through the unloader valve and its bypass channel. It is necessary in high powered heat pump installations that some protective method must be found to provide relief for the high head pressures which periodically occur in abnormal operating conditions in order to prevent unscheduled shut down of the equipment or serious damage to the heat pump installation in the event some form of relief is not provided.

SUMMARY OF THE INVENTION

This invention provides a solution to the high head pressures which occur in abnormal circumstances in the operation of a heat pump in which both the refrigerant condenser and evaporator coils are each connected to a secondary heat transfer loop wherein the heat from the secondary loop is either carried away from or carried to its respective refrigerant coil.

It is a well known fact that for a particular heat pump installation that the head pressure and the temperature of the compressed refrigerant gas leaving the compressor bear an almost direct relationship. This invention seeks to sense the pressure existing at the head of the compressor by measuring the hottest temperature of the cooling fluid in the secondary circuit connected in heat transfer relationship with the condenser and adjusting the flow of the heat transfer fluid flowing in the secondary circuit connected in heat transfer relationship with the evaporator. If the temperature measured increases beyond a certain predetermined temperature, the flow of heat transfer fluid flowing in the secondary circuit connected to the evaporator is reduced, and vice versa.

A simple electronic circuit which in itself is not the subject of this invention serves in this instance to control the rotational speed of the motor pumping heat transfer fluid in the secondary circuit connected to the evaporator.

BRIEF DESCRIPTION OF THE DRAWING

The FIGURE is a schematic diagram of a heat pump installation embodying the invention of this application.

DESCRIPTION OF THE PREFERRED EMBODIMENT

The FIGURE shows a heat pump installation 10 having what will in the following description be referred to as an augmented evaporator and condenser. Heat pump installation 10 comprises a motor compressor 12 which comprises a refrigerant such as FREON TM and passes the hot compressed refrigerant onto condenser 14 where it is cooled. Condenser 14 is connected in intimate heat transfer relationship with heat transfer coil 16 which circulates a heat transfer fluid such as water around a secondary circuit in the direction of the arrow shown. The heat transfer fluid passes through a second heat exchanger 18 which may be in the form of a multi-finned radiator for the dissipation of heat to the surrounding medium. A fan 20 may be used to provide additional cooling of radiator 18. A pump may be used to circulate the heat transfer fluid around the loop provided.

After the refrigerant fluid is cooled in condenser 14, it is then in a liquid state and the refrigerant passes through conduit 24 to receiver 15 where it is stored until it is fed through expansion valve 26 where the refrigerant fluid passes from a liquid to a gas and subsequently becomes very cold. The cold refrigerant passes from the expansion valve 26 to the evaporator coil 28 which is connected in intimate heat transfer relationship with a secondary coil 30 through which a second heat transfer fluid is circulated. This heat transfer fluid may be anyone of a number of fluids including water, brine or ethylene glycol depending on the environment to which the heat transfer fluid is to be subjected.

Coil 30 is connected via appropriate conduit to a heat source which may be at some distance from the location of the coil 30 and pump 32 is provided to pump the heat transfer fluid around the secondary circuit containing coil 30. The heat source may be a hot water storage tank, or a solar panel or some other suitable source of heat.

Pump 32 in this instance will be preferably driven by an electric motor, the speed of which is infinitely variable depending on the electrical input to the motor.

Lastly, the warmed refrigerant fluid is passed from the evaporator coil 28 and returned to the compressor.

It will be noted that pump 32 is connected to control circuit 36 by a pair of wires 38 and 40. The control circuit is able to produce an output signal which varies in accordance with an input signal to vary the output signal to drive motor 32 at different speeds.

The control circuit 36 is fed an input signal from temperature sensing device 42 along conductors 44 and 46. Heat sensor 42 may be a variety of devices, but preferably will be a thermistor which is mounted on coil 16 at a location where coil 16 is the hottest.

Sensor 42 thus supplies control circuit 36 with a signal proportional to the hottest temperature of the coil 16, which of course is an excellent sample of the temperature of the hottest portion of coil 14, which is directly proportional to the head pressure of the compressor.

Control circuit 36 then produces a signal causing pump 32 to circulate the secondary heat transfer fluid through coil 30 at a specific rate. If the temperature sensed by heat sensor 42 increases, the control circuit 36 cuts back the speed of pump 32. This allows less flow of heat transfer fluid in the coil 30 and consequently allows evaporator coil 28 to run colder, thus partially unloading the compressor. It has been found that a small amount of experimentation may be required initially to set the control circuit 36 for stable operation, but once stable operation has been reached, no further adjustment is necessary.

Modifications are of course possible. Pump 32 may be replaced by a pump whose speed is constant, but whose output may be controlled by a control valve in the circuit containing coil 30. The control valve may be controlled electrically, pneumatically or hydraulically depending on the application.

The circuit described effectively functions to produce a heat pump installation in which the effective heat transfer capacity of the evaporator is variable. It will be found that if the heat source feeding coil 30 is at a fairly high level with respect to the heat sink energy level, that the flow of fluid through coil 30 will be severely cut down, thus effectively reducing the size of evaporator 28.

If on the other hand, the temperature of the heat source is low with respect to the temperature of the heat sink, it will be found that control circuit 36 drives the pump 32 much harder so that the flow of the heat transfer fluid in coil 30 is drastically increased, thus increasing the effective area of the evaporator coil.

It will be seen then that the control circuit 36 thus provides an operating balance to the refrigerant circuit to adjust the effective size of the evaporator of the heat pump depending on the difference in temperatures existing at the heat sink (temperature of coil 14) and the temperature of the heat source (temperature of coil 28).

The control circuit 36 thus provides a balance of the heat flow between evaporator and condenser. Generally speaking, the factory installation service crew chooses the rate of heat transfer between the condenser and the surrounding medium by initially setting the control circuit to operate in such a manner as to keep the temperature at heat sensor 42 at a chosen operable setting.

After this setting is established, the control circuit 36 merely adjusts the flow of the heat transfer fluid in coil 30 to maintain optimum heat transfer in the heat pump.

Control of the unit in an operating installation may be accomplished in a number of ways. The sensing circuit may be set by factory personnel so that whenever the unit is operating, maximum heat will be delivered by the condenser, i.e. the interior of the building will receive the maximum heat input while the unit is operating.

A secondary control circuit under the control of a sensing thermostat can be made to shut the compressor and associated pumps and fans off once the desired room temperature is reached. Control by such a device would be much the same as operation of a domestic furnace where the furnace burner is controlled by the sensing thermostat, but the blower circulating air through the heat exchange system continues to operate as long as the bonnet is above a certain temperature.

If it is desired to have the compressor and associated fans run continuously, it is possible to have a second circuit vary the flow of the secondary heat transfer fluid between a pair of chosen limits such that a minimum flow of secondary fluid to the evaporator gives a minimum heat output of the condenser and when the temperature sensor calls for a high heat demand, the system moves to the maximum heat flow of secondary fluid to the evaporator—until the demand for heat slackens at which time the control begins to cut back the flow of secondary heat transfer fluid to the evaporator until a balance is reached where the flow of secondary fluid yields sufficient heat to the system to balance the heat being lost by the building being heated.

Temperature sensing means 42 is located on coil 16 for convenience. The sensor 42 would function equally well if the hottest part of condenser 14 were conveniently available for mounting the sensor 42 thereon.

Of course, if it is desired to measure the head pressure directly, a transducer may be mounted in the condenser circuit which measures the actual head pressure and produces an output signal proportional to the actual head pressure, but this tends to be expensive and for most applications, the method set out by this application is sufficiently accurate to provide stable operation of the heat pump.

The embodiments of the invention in which an exclusive property or privilege is claimed are defined as follows:

1. A heat pump comprising:

a motor compressor, a condenser, an evaporator, an expansion valve, connected in a primary operating loop in which said compressor pumps heat from said evaporator to said condenser, first secondary heat transfer means and associated conduit means connected in good heat transfer relationship with said evaporator to carry a first secondary heat transfer fluid through said first secondary heat transfer means to transfer heat to said evaporator, and flow means to cause said secondary heat transfer fluid to flow through said first heat transfer means and associated conduit, second secondary heat transfer means and associated conduit means connected in good heat transfer relationship with said condenser to carry a second secondary heat transfer fluid through said second secondary heat transfer means to transfer heat from said condenser and second flow means to cause said secondary heat transfer fluid to flow through said second heat transfer means and associated conduit, sensing means mounted in said heat pump for sensing a variable quantity which is proportional to the head pressure of the compressor, and control means to control said flow means in said first secondary heat transfer means to vary the flow of said secondary heat transfer fluid inversely with the head pressure of said compressor.

2. A heat pump as claimed in claim 1, wherein the sensing means comprises a temperature sensor mounted on the heat pump to sense the hottest temperature existing in said condenser.

3. A heat pump as claimed in claim 2 wherein the flow means comprises a pump.

4. A heat pump as claimed in claim 1, wherein the sensing means comprises a temperature sensing means mounted on said first heat transfer means to sense the hottest temperature of said first secondary heat transfer means.

5. A heat pump as claimed in claim 4 wherein the flow means comprises a pump.

* * * * *